US006315935B1

(12) United States Patent
Schoonover et al.

(10) Patent No.: US 6,315,935 B1
(45) **Date of Patent: *Nov. 13, 2001**

(54) LOW PRESSURE INJECTION MOLDING OF KNIFE BLADES FROM METAL FEEDSTOCKS

(75) Inventors: James Schoonover, Flemington; Brian Snow, Parsippany; Michael Sean Zedalis, Mendham, all of NJ (US)

(73) Assignee: AlliedSignal Inc., Morris Township, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/383,719

(22) Filed: Aug. 26, 1999

(51) Int. Cl.[7] ..... C04B 35/64

(52) U.S. Cl. ..... 264/109; 264/621; 264/328.2; 419/36

(58) Field of Search ..... 264/109, 621, 264/328.2; 419/36

(56) References Cited

U.S. PATENT DOCUMENTS 5,250,254 * 10/1993 Achikita et al. ..... 419/37
5,258,155 * 11/1993 Sekido et al. ..... 264/109
5,737,683 4/1998 Sterzel ..... 419/36
5,746,957 * 5/1998 Fanelli et al. ..... 264/109

FOREIGN PATENT DOCUMENTS 0-480-107 4/1992 (EP) .

OTHER PUBLICATIONS

Whistler, Roy L., et al., "Industrial Gums", Second Edition, Academic Press, New York and London, 1973.

* cited by examiner

*Primary Examiner*—Mary Lynn Theisen
(74) *Attorney, Agent, or Firm*—Roger H. Criss

(57) ABSTRACT

A process for molding metal knife blades from powders and molding compositions therefor are disclosed. Parts produced by this process are formed near net shape without the need for machining or other finishing operations. The process comprises forming a mixture containing metal powders, a gel-forming material and an aqueous gel-forming material solvent, and molding the mixture in an injection molding machine under conditions of temperature and pressure to produce a self-supporting knife blade having a sharp edge.

26 Claims, 3 Drawing Sheets

KNIFE BLADE MANUFACTURING / INJECTION MOLDING PROCESS

KNIFE BLADE MANUFACTURING / INJECTION MOLDING PROCESS

LOW PRESSURE INJECTION MOLDING OF KNIFE BLADES FROM METAL FEEDSTOCKS

FIELD OF THE INVENTION

This invention relates to a process for shaping metal parts from powders and molding compositions therefor. More particularly, the invention is directed to molding processes and molding compositions for forming long, thin sections and cross sections that can be readily fired to produce near net-shape articles without the need for machining or other shaping and finishing operations.

BACKGROUND OF THE INVENTION

There are several different techniques used to make knife blades in the art known as bladesmithing. One process is forging, in which the steel blade is formed by a series of high pressure and force impacts until the desired shape is obtained. This process takes a relatively long time and requires the use of large, expensive machinery. Another process used to fabricate thinner blades is known as fine blanking, in which a strip of steel is uncoiled, straightened, flattened and moved into position where a die grips the steel while a punch forces the material into a cavity and counter punches perforate any holes required in the blade. This process is slower and more costly than conventional blanking. Prior to employing either of these processes, a precisely controlled tempering operation must be performed in order to produce hardened steel blades that are capable of maintaining a sharp edge. Following either of these processes, a final step must be performed to hollow grind the finished cutting edge on the blade.

In order to overcome some of the shortcomings of these prior art methods of making knife blades, injection molding techniques have been found to be ideally suited for high volume manufacturing of near net-shape blades. This process produces knife blades that have desired physical properties without the need to perform costly finishing operations. The process is relatively inexpensive and offers considerable advantages over processes that require additional machining and finishing operations to produce acceptable blades. Low pressures and temperatures are employed to shape the finished blades using aqueous feedstocks made from metal powders.

BRIEF SUMMARY OF THE INVENTION

The invention is directed to a process for forming a knife blade comprising the steps of forming a mixture comprising a metal powder, a gel-forming material and an aqueous gel-forming material solvent; and molding the mixture in a mold under conditions of temperature and pressure sufficient to produce a self-supporting article.

The invention also provides an injection molding process for forming a knife blade comprising the steps of forming a mixture comprising a metal powder, a gel-forming material selected from the group of polysaccharides consisting of agaroids and an aqueous gel-forming material solvent; supplying the mixture to an injection molding machine having a mold therein, the mixture being maintained during the supply step at a first temperature above the gel point of the gel-forming material; and cooling the mixture in the mold to a second temperature below the gel point of the gel-forming material to form the knife blade.

BRIEF DESCRIPTION OF THE DRAWINGS

The invention will be more fully understood and further advantages will become apparent when reference is made to the following detailed description and the accompanying drawings in which.

DETAILED DESCRIPTION OF THE INVENTION

Figure 1:
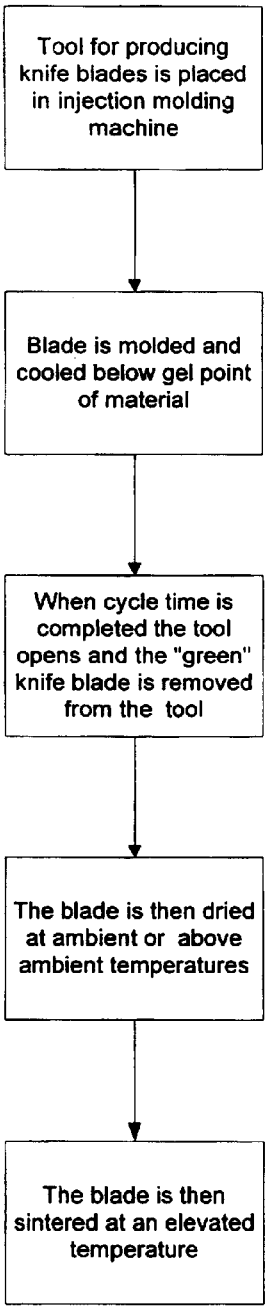
FIG. 1 is a schematic flow diagram of one embodiment of a method for the manufacture of metal knife blades according to the present invention.

Metal knife blades are formed according to the present invention from metal powders, preferably in injection molding machines at low pressures and temperatures. As used herein, the term metal powders includes powders of pure metals, alloys, intermetallic compounds and mixtures thereof.

According to the process of this invention, the metal powder is initially mixed with a gel-forming material and a solvent for the gel-forming material. This mixture is then mixed with a proportionate amount of a carrier to make it fluid enough to enable it to be readily supplied to a mold by any of a variety of techniques. A preferred technique is injection molding. Generally, the amount of powder in the mixture is between about 35 to 65% by volume of the mixture. Preferably, the powder constitutes between about 40 to 62% by volume of the mixture, and most preferably constitutes between about 45 to 60% by volume of the mixture. The aforementioned amounts are especially well suited for production of net and near net shape injection molded knife blades.

The gel-forming material employed in the mixture is an agaroid, which has been defined as a gum resembling agar but not meeting all of the characteristics thereof (See H. H. Selby et al., "Agar," *Industrial Gums,* Academic Press, New York, N.Y., $2^{nd}$ ed., 1973, Chapter 3, p. 29). As used herein, however, agaroid not only refers to any gums resembling agar, but also to agar and derivatives thereof such as agarose. An agaroid is employed because it exhibits rapid gelation within a narrow temperature range, a factor that can dramatically increase the rate of production of articles being manufactured. The preferred gel-forming materials are those that are water-soluble and include agar, agarose and carrageenan. The most preferred gel-forming materials include agar, agarose and mixtures thereof.

The gel-forming material is provided in an amount preferably between about 0.5 to 6 wt % based upon the amount of solids in the mixture. It should be understood that more than about 6 wt % of the gel-forming material may be employed in the mixture. Such higher amounts are not believed to have any adverse impact on the process, although these higher amounts may begin to reduce some of the advantages produced by the novel compositions of the present invention, especially with respect to the production of near net shape bodies. Most preferably, the gel-forming material comprises between about 1 to 3% by weight of solids in the mixture.

The mixture further includes a gel-forming solvent in an amount sufficient to dissolve the gel-forming material. While any of a variety of solvents may be employed depending upon the composition of the gel-forming material, especially useful solvents for agaroid containing gel-forming materials are polyhedric liquids, particularly polar solvents such as water or alcohols. It is, however, most preferable to employ a solvent which can also perform the dual function of being a carrier of the mixture, thus enabling the mixture to be easily supplied to a mold. Water has been found to be particularly well suited to perform this dual function.

A liquid carrier is normally added to the mixture to produce a homogeneous mixture having a viscosity that allows it to be readily molded by the desired molding process. Ordinarily, the liquid carrier is added in an amount necessary to ensure the proper fluidity of the mixture. Generally, the amount of a liquid carrier is between about 40 to 60% by volume of the mixture depending upon its desired viscosity. In the case of water, which performs the dual function of a solvent and a carrier for agaroid-containing mixtures, the amount is generally between about 35 to 60% by volume of the mixture, with amounts between about 40 to 55% by volume being preferred. In addition, because of its low boiling point, water is easily removed from the body prior to and/or during firing of the molded article.

The mixture may also contain a variety of additives that can serve any number of useful purposes. For example, dispersants may be employed to ensure a more homogeneous mixture. Biocides may be used to inhibit bacterial growth in the molding compositions, especially if they are to be stored for a long period of time. A gel strength enhancing additive may be employed to further improve the processability and yield of molded knife blades. The preferred gel strength-enhancing agents are chosen from the class of borate compounds including, but not limited to, calcium, magnesium, zinc and ammonium borate. The most preferred compound has been found to be calcium borate. The gel strength-enhancing compound is preferably used in an amount of approximately ca. 0.2 to 1 wt % based on the liquid carrier.

The components of the molding formulation are compounded in a heated blender that provides shearing action thereto, creating a homogeneous mixture of high viscosity. The shearing action is instrumental in producing compositions of high solids loading in a dispersed and uniform state, highly suitable for subsequent injection molding. Ability to form uniform compositions of high solids loading is desirable in the production of injection molded parts. Use of compositions with high solids concentration results in lower shrinkages when the molded parts are dried and fired, facilitating close dimensional control and mitigating the tendency for cracks to form during the densification process. The benefits afforded by this process include higher yields of acceptable product and lower scrap rates. This can have a significant effect on the cost of the overall process and may determine whether injection molding is lower in cost relative to other fabrication processes for a particular component.

The mold for fabricating the knife blades may be made by any number of methods well known to those skilled in the art. For example, a metal mold for forming the desired knife blade shape may be made by machining a cavity in the shape of the desired blade into a metal block. Soft tooling in the form of resins or particulate reinforced resins can be made using casting techniques. In the latter case a cavity in the shape of the desired blade may be formed by casting around a master. The master can be made by any number of suitable methods well known to those skilled in the art, such as by machining or grown SLA masters. Resin, most preferably urethane or epoxy, is pre-mixed with the reinforcement filler and cast around the master. After the resin cures to a solid, the master is removed and secondary operations can be performed to create a finished, multiple-use tool for production of parts from powder feedstocks. The tool may incorporate other desirable features, such as cooling lines, removable sprue and ejector systems.

The mixture is supplied to the mold by any of a variety of well-known techniques including gravity feed systems and pneumatic or mechanical injection systems. Injection molding is the most preferred technique because of the fluidity and low processing temperatures and pressures of the mixtures. These features, low processing temperatures and pressures, are especially attractive in reducing abrasive and erosive wear of the injection molding equipment. The mixture is transported to the mold at a temperature above the gel point (temperature) of the gel-forming material. Ordinarily, the gel point of the gel-forming material is between about 10 to 60° C., and most preferably is between about 30 to 45° C. A wide range of molding pressures may be employed. Generally, the molding pressure (hydraulic) is between about 100 to 1500 psi, although higher or lower pressures may be employed depending upon the molding technique used. Preferably, the molding pressure is in the range of about 150 to 1000 psi, and most preferably is between about 250 to 800 psi.

The mold temperature must, of course, be at or below the gel point of the gel-forming material in order to produce a self-supporting body. The appropriate mold temperature can be achieved before, during or after the mixture is supplied to the mold. Ordinarily, the mold temperature is maintained at less than about 40° C., and preferably is between about 15 to 25° C. Thus, for example, it is expected that optimum production rates would be achieved with an injection molding process wherein the preferred gel-forming materials (which exhibit gel points between about 30 to 45° C.) are employed to form a mixture, and wherein the mixture is injected at less than about 100° C. into a mold maintained at about 25° C. or less.

After the knife blade is molded and cooled to a temperature below the gel point of the gel-forming material, the "green" part is removed from the mold, dried to remove the water and then fired at elevated temperatures to remove the binder and density the body. Drying may be accomplished at ambient and/or above ambient temperatures. The firing times and temperatures (firing schedules) are regulated according to the powder material employed to form the blade. Firing schedules are well known in the art for a multitude of materials and need not be described herein.

The process for manufacturing knife blades by injection molding according to the present invention is illustrated in FIG, 1. The tool for producing the knife blades is placed in an injection molding machine. The blade is molded as described hereinabove and cooled below the gel point of the material. The tool then opens and the "green" knife blade is removed from the tool. It is allowed to dry at ambient or above ambient temperatures to remove the water. The dried blade is then sintered at elevated temperatures according to well-known firing schedules for the blade material being used to obtain the desired properties. The sintered blade needs little or no further finishing operations and possesses a sharp cutting edge.

One of the most important advantages achieved by the present invention is the production by the aforementioned process of knife blades that have the necessary sharp cutting edges without the need for further hollow grinding, as the prior art processes require. While not an absolute limitation, it has been found that molded "green" blades having a maximum length/thickness ratio of approximately 9.5 in./0.2 in. tapering to a point results in optimal performance.

Having thus described the invention in full, clear and concise terminology, the following example is provided to illustrate an embodiment of the invention. The example, however, is not intended to limit the scope of the invention to anything less than is set forth in the appended claims.

EXAMPLE

Figure 2:
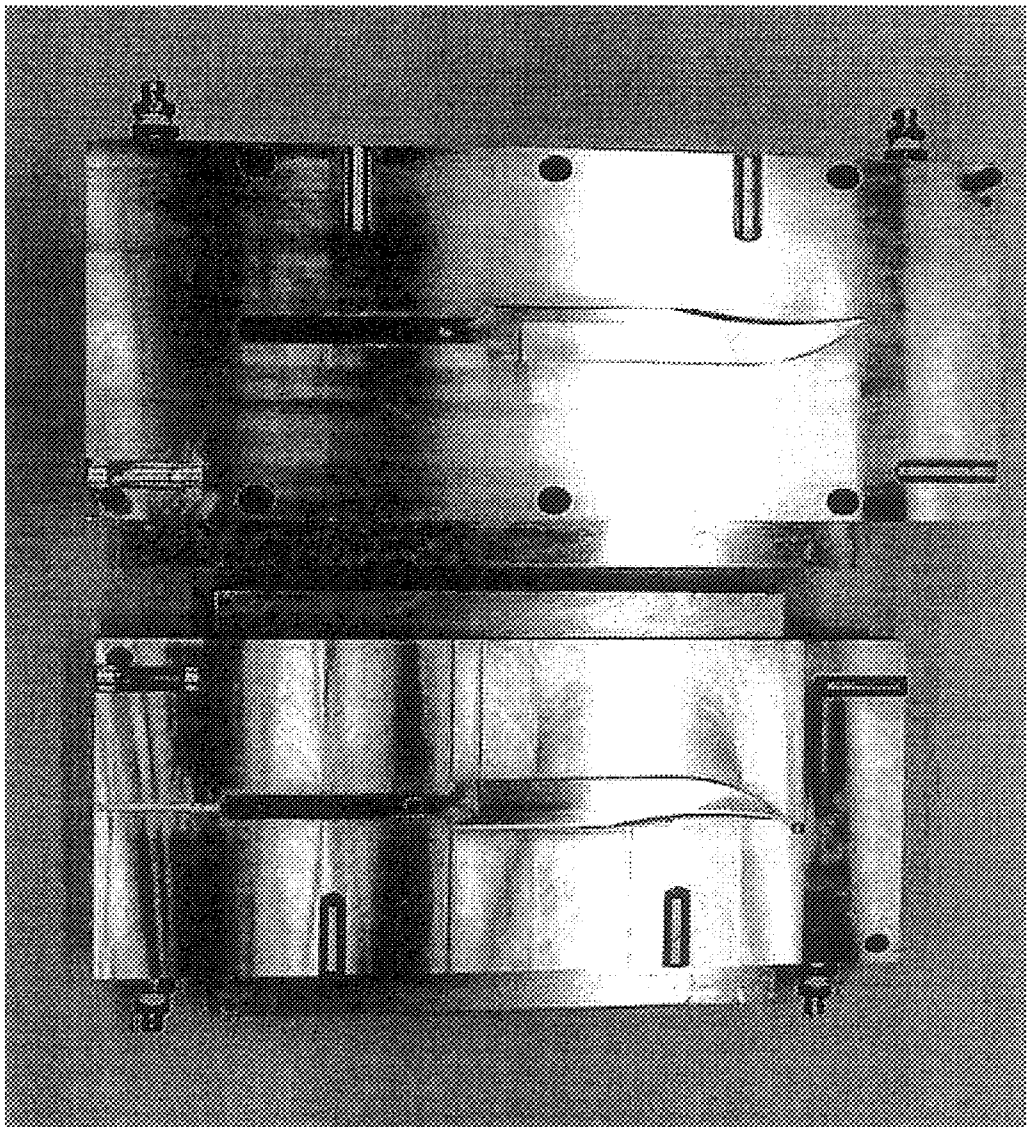
FIG. 2 is a photograph of the aluminum tool used to form the knife blades by low pressure injection molding using aqueous stainless steel feedstock.
Figure 3:
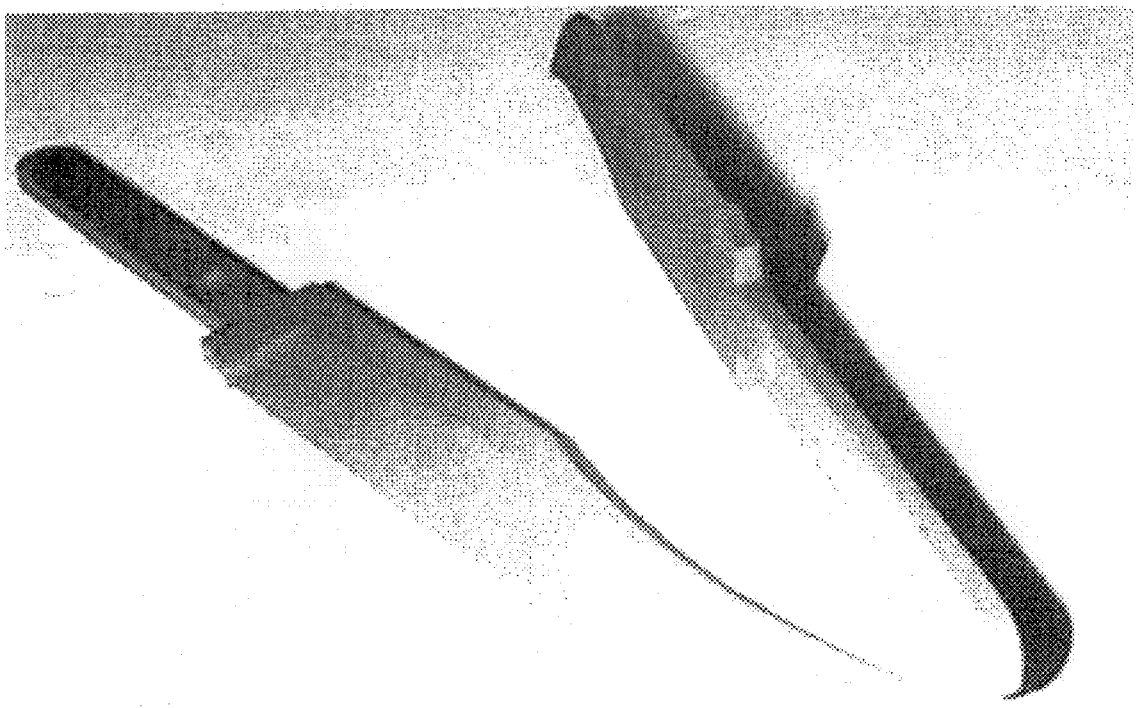
FIG. 3 is a photograph of knife blades manufactured according to the present invention.

A 3-D CAD file was used to generate a machine path for cutting the cavity and core of the knife blade into two plates of 7075 aircraft grade aluminum. The plates were then assembled along with sprue bushing, an ejector system, support brackets and a locating ring to form a self-standing tool. The tool, shown in FIG. 2, was installed on a Cincinnati Milicron 85 ton reciprocating screw injection molding machine. The near net shape knife blades were then molded from aqueous 316L stainless steel feedstock material using hydraulic pressures of approximately 400 to 700 psi and a barrel temperature of approximately 185° F. The mold temperature was controlled at 55° F. by means of a chiller. The finished knife blades, shown in FIG. 3, were dried for approximately 24 hours and then sintered in an air atmosphere using standard sintering schedules for 316L stainless steel.

What is claimed is:

1. A process for forming a long, thin cross section article having a complex shape comprising the steps of:

a) forming a mixture comprising,
   1) powder containing at least one member selected from the group consisting of pure stainless steel alloys, stainless steel alloying elements, intermetallic compounds, components of metal matrix composites and mixtures thereof;
   2) a gel-forming material;
   3) an aqueous gel-forming material solvent; and
   4) a gel strength enhancing agent selected from the group consisting of calcium borate, magnesium borate, zinc borate and ammonium borate; and b) molding the mixture in a mold containing a cavity for shaping the article under conditions of temperature and pressure sufficient to produce a self-supporting article.

2. The process of claim 1, wherein the gel-forming material is selected from the group of polysaccharides consisting of agaroids.

3. The process of claim 2, wherein the agaroid is agar, agarose or a mixture thereof.

4. The process of claim 1, wherein the aqueous gel-forming material solvent is water.

5. The process of claim 1, wherein the powder comprises between about 50 to 96 wt % of the mixture.

6. The process of claim 1, wherein the gel-forming material comprises between about 0.5 to 10 wt % of the mixture.

7. The process of claim 1, further comprising the step of maintaining the mixture at a temperature above the gel point of the gel-forming material prior to the molding step.

8. The process of claim 7, wherein the temperature of the mixture during the molding step is reduced to a value below the gel point of the gel-forming material.

9. The process of claim 1, wherein the mixture further comprises additives including a biocide, a coupling agent, a dispersant and monomeric mono and/or polyhedric alcohol.

10. The process of claim 1, wherein the borate compound is present in an amount up to about 10 wt % of the gel-forming material solvent in the mixture.

11. The process of claim 1, wherein the hydraulic molding pressure is less than about 1500 psi and the molding temperature is less than about 212° F.

12. The process of claim 1, wherein the article is a knife blade.

13. The process of claim 1, wherein the article is a knife blade whose maximum length/thickness ratio is approximately 9.5 in./0.2 in. tapering to a point.

14. An injection molding process for forming a knife blade having a sharp edge comprising the steps of:

a) forming a mixture comprising,
   1) powder selected from the group consisting of metal powders, ceramic powders and mixtures thereof;
   2) a gel-forming material selected from the group of polysaccharides consisting of agaroids;
   3) an aqueous gel-forming material solvent; and
   4) a gel strength enhancing agent selected from the group consisting of calcium borate, magnesium borate, zinc borate and ammonium borate;

b) supplying the mixture to an injection molding machine having a mold containing a cavity for shaping the knife blade, the mixture being maintained during the supply step at a first temperature above the gel point of the gel-forming material; and c) cooling the mixture in the mold to a second temperature below the gel point of the gel-forming material to form the knife blade.

15. The process of claim 14, wherein the agaroid is agar, agarose or a mixture thereof.

16. The process of claim 14, wherein the aqueous gel-forming material solvent is water.

17. The process of claim 14, wherein the powder comprises between about 50 to 96 wt % of the mixture.

18. The process of claim 14, wherein the gel-forming material comprises between about 0.5 to 10 wt % of the mixture.

19. The process of claim 14, wherein the mixture further comprises additives including a biocide, a coupling agent, a dispersant and monomeric mono and/or polyhedric alcohol.

20. The process of claim 14, wherein the borate compound is present in an amount up to about 10 wt % of the gel-forming material solvent in the mixture.

21. The process of claim 14, wherein the hydraulic molding pressure is less than about 1500 psi and the molding temperature is less than about 212° F.

22. The process of claim 14, wherein the knife blade has a maximum length/thickness ratio of approximately 9.5 in./0.2 in. tapering to a point.

23. The process of claim 14, wherein the borate compound is calcium borate.

24. The process of claim 23, wherein the calcium borate is present in an amount between about 0.2 to about 1 wt % of the gel-forming material solvent in the mixture.

25. The process of claim 1, wherein the borate compound is calcium borate.

26. The process of claim 25, wherein the calcium borate is present in an amount between about 0.2 to about 1 wt % of the gel-forming material solvent in the mixture.

* * * * *